US006332812B1

(12) United States Patent
Kazuhara

(10) Patent No.: US 6,332,812 B1
(45) Date of Patent: Dec. 25, 2001

(54) CONNECTOR ASSEMBLY

(75) Inventor: Hitoshi Kazuhara, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/604,464

(22) Filed: Jun. 27, 2000

(30) Foreign Application Priority Data

Jun. 28, 1999 (JP) ..... 11-182035

(51) Int. Cl.[7] ..... H01R 13/502; H01R 13/514
(52) U.S. Cl. ..... 439/701; 439/717
(58) Field of Search ..... 439/587, 589, 439/701, 594, 695, 696, 717

(56) References Cited

U.S. PATENT DOCUMENTS 4,046,452 * 9/1977 Cassarly ..... 439/701

FOREIGN PATENT DOCUMENTS

2706688 * 12/1994 (FR) ..... 439/701
05-251132 * 9/1993 (JP) ..... 439/701

* cited by examiner

*Primary Examiner*—Paula Bradley
*Assistant Examiner*—Felix O. Figueroa
(74) *Attorney, Agent, or Firm*—Sughrue Mion, PLLC

(57) ABSTRACT

In a connector assembly, an upper connector housing (3) and a lower connector housing (5), each having male terminals (2, 4) mounted therein, are combined together in a stacked manner. Dovetail grooves (17) and elongate projections (11) for fitting respectively in the dovetail grooves (17) are provided at engagement portions of the two connector housings (3, 5) to be engaged with each other. The upper connector housing (3) is slid relative to the lower connector housing (5) in an extending direction of the male terminals (2, 4) through the dovetail grooves (17) and the elongate projections (11) so as to fittingly connect the upper connector housing (3) to the lower connector housing (5).

3 Claims, 5 Drawing Sheets

CONNECTOR ASSEMBLY

BACKGROUND OF THE INVENTION

1. Field of the Invention

The present invention relates to a connector assembly in which an upper connector housing and a lower connector housing, each having male terminals mounted therein, are combined together in a stacked manner, with these male terminals directed in the same direction. Particularly, the present invention relates to a connector housing-combining structure.

The present application is based on Japanese Patent Application No. Hei. 11-182035, which is incorporated herein by reference.

2. Description of the Related Art

In order to increase a packaging density in a connector, there has been proposed a connector assembly in which a plurality of connector housings are connected or combined together in a stacked manner.

FIG. 4 shows such a connector assembly. This connector assembly 20 comprises an upper connector housing (hereinafter referred to as "upper housing") 22, having many juxtaposed male terminals 21, a lower connector housing (hereinafter referred to as "lower housing") 24, having many juxtaposed male terminals 23, and a cover 25.

Claws 26 are formed respectively on inner surfaces of opposite side walls of the upper housing 22 at a front end thereof, and projections 27 are formed respectively on outer surfaces of the opposite side walls at a rear end portion of the upper housing 22. Claws 28 for engagement respectively with the claws 26 on the upper housing 22 are formed respectively on inner surfaces of opposite side walls of the lower housing 24 at a front end thereof, and upstanding tongue portions 29 are formed respectively on rear end portions of the opposite side walls of the lower housing 24, and holes 30, in which the projections 27 on the upper housing 22 can be engaged, respectively, are formed in the tongue portions 29, respectively. A hole 31, used for attaching the cover 25, is formed in each of the tongue portions 29, and is disposed below the hole 30. Projections 32 for engagement respectively in the holes 31 in the lower housing 24, are formed respectively on outer surfaces of opposite side walls of the cover 25 at a rear end portion thereof.

In this connector assembly 20, the cover 25 is placed on the lower housing 24, and the projections 32 on the cover 25 are fitted respectively in the holes 31 in the lower housing 24, thereby connecting the cover 25 to the lower housing 24. Then, the upper housing 22 is placed on this assembly, and the claws 26 on the upper housing 22 are engaged respectively with the claws 28 on the lower housing 24 while the projections 27 on the upper housing 22 are engaged respectively in the holes 30 in the lower housing 24, thereby connecting the upper housing 22 to the lower housing 24.

In the above connector assembly 20, when connecting the upper housing to the lower housing, the front end of the upper housing is first engaged with the front end of the lower housing, and then the upper housing is pivotally moved about this front end portion so as to engage the rear end of the upper housing with the rear end of the lower housing.

Therefore, during this operation, there is a possibility that the male terminals in the upper housing are brought into contact with the male terminals in the lower housing, so that these male terminals may be bent.

To overcome this problem, there may be proposed a connector assembly in which an upper housing is slid relative to a lower housing in a direction of extending of male terminals in the lower housing, and is fitted relative thereto.

In this connector assembly, the upper housing is brought into engagement with the lower housing in a direction parallel to the male terminals in the lower housing, and therefore there is no chance that male terminals in the upper housing interfere with the male terminals in the lower housing.

However, in such a connector assembly, projections, formed respectively on rear portions of opposite side walls of the upper housing, are engaged respectively in holes, formed respectively in tongue portions formed respectively on rear portions of opposite side walls of the lower housing, so as to combine the upper housing with the lower housing, and therefore there is a possibility that the front end of the upper housing is separated from the lower housing.

SUMMARY OF THE INVENTION

It is therefore an object of the present invention to provide a connector assembly in which an upper housing can be firmly combined with a lower housing in such a manner that the upper housing will not be separated from the lower housing.

To achieve the above object, according to the first aspect of the present invention, there is provided a connector assembly which comprises a lower connector housing having a first engagement portion, an upper connector housing being able to be stacked on and combined with the lower connector housing, the upper connector housing having a second engagement portions a plurality of terminals respectively insertable into the upper and lower connector housings, the terminals being directed in the substantially same direction when the upper and lower connector housings are completely combined together, at least one dovetail groove formed in one of the first and second engagement portions, and at least one elongate projection formed on the other one of the first and second engagement portions, the at least one elongate projection being fitted in the at least one dovetail groove while the upper connector housing is slid relative to the lower connector housing in an extending direction of the terminals.

In the above connector assembly, the elongate projection is fitted in the dovetail groove, thereby combining the two connector housings together without separation.

Further, according to the second aspect of the present invention, it is preferable that the upper connector housing has one of a projection and a hole at a rear end portion thereof, the lower connector housing has the other one of the projection and the hole at a rear end portion thereof, the upper connector housing has the second engagement portion at a front end portion thereof, and the lower connector housing has the first engagement portion at a front end portion thereof, and wherein the upper connector housing is slid relative to the lower connector housing in the extending direction of the terminals, and is completely combined with the lower connector housing, so that the at least one elongate projection is fitted in the at least one dovetail groove, and the projection and the hole are engaged with each other.

In the above connector assembly, the upper connector housing can be engaged with the lower connector housing merely by sliding the upper connector housing relative to the lower connector housing. Therefore, the combining operation is easy, and besides the elongate projection, formed on one of the upper and lower connector housings, is fitted in the dovetail groove formed in the other connector housing, so that the two connector housings are combined together, and therefore the two connector housings can be combined together without being displaced relative to each other in the direction of the width and also without being separated from each other. Accordingly, it is more preferable that the projection has a tapering surface which is tapered toward a rear end of one of the upper and lower connector housings in a direction in which the upper connector housing is slid relative to the lower connector housing to be completely combined with the lower connector housing.

Further, according to the third aspect of the present invention, the connector assembly may further comprise a cover attachable to be located between the upper and lower connector housings so as to partially cover the terminals respectively arranged in the upper and lower connector housings.

Furthermore, according to the fourth aspect of the present invention, it is preferable that the at least one elongate projection being fitted in the at least one dovetail groove to prevent separation of the upper and lower connector housings from each other so that the upper connector housing is slid in substantially parallel to the lower connector housing.

DETAILED DESCRIPTION OF THE PREFERRED EMBODIMENT

One preferred embodiment of a connector assembly of the present invention will now be described in detail with reference to the accompanying drawings.

Figure 1:
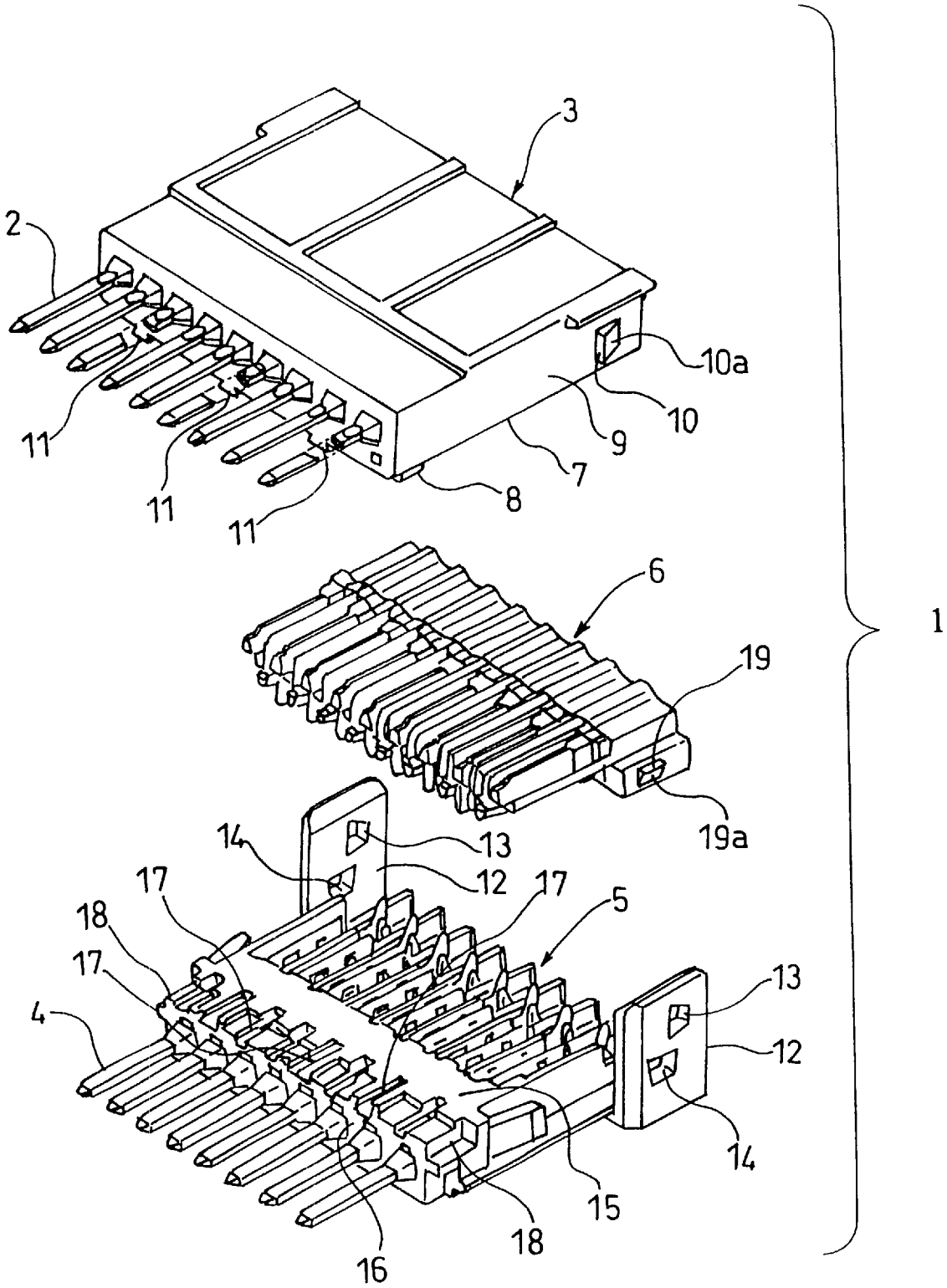
FIG. 1 is an exploded, perspective view of one preferred embodiment of a connector assembly of the present invention.
Figure 2:
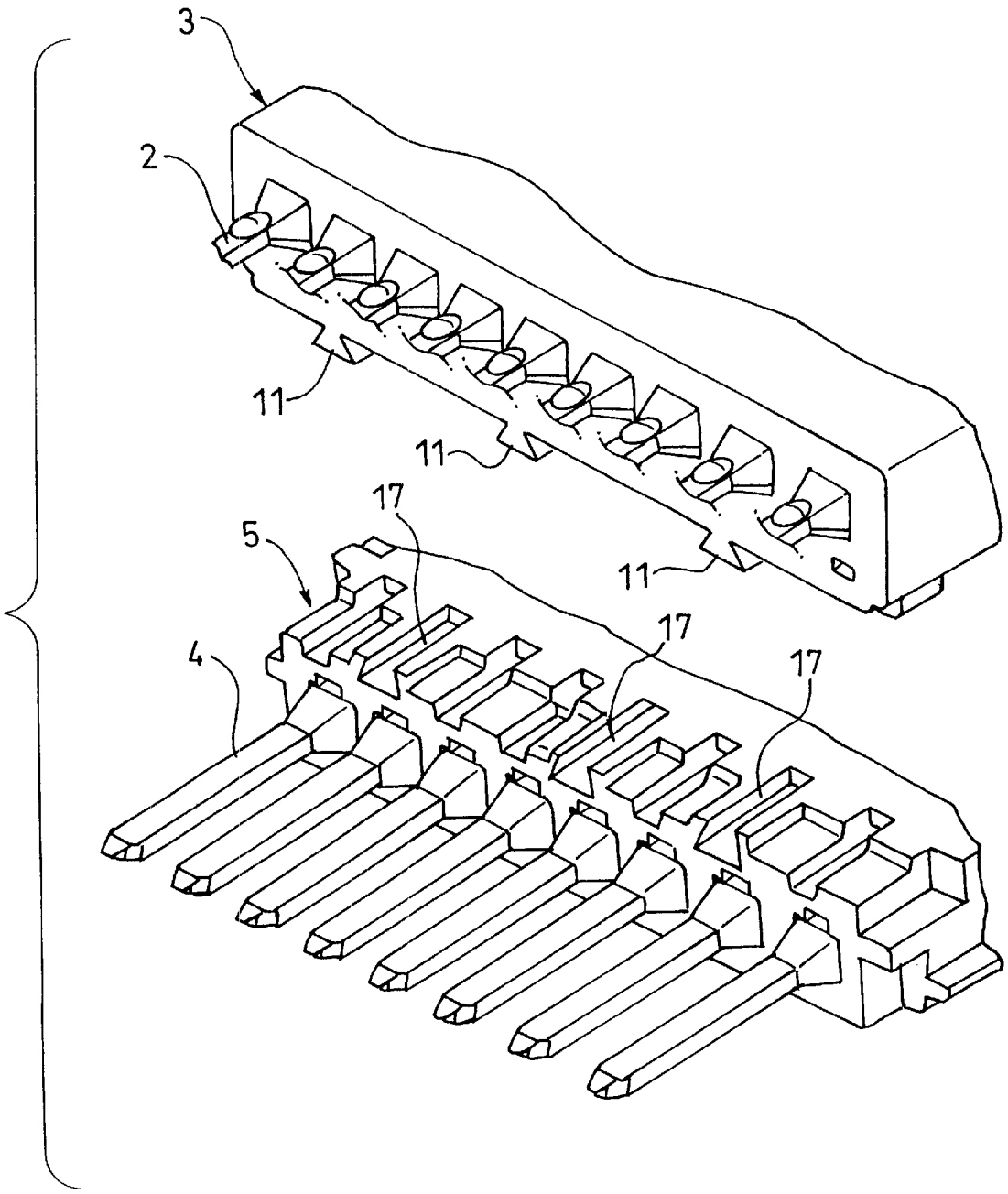
FIG. 2 is an enlarged view of an important portion in FIG. 1.

FIG. 1 is an exploded, perspective view of one embodiment of the connector assembly of the present invention, and FIG. 2 is an enlarged view of an important portion in FIG. 1.

Like the above-mentioned, related connector assembly 20, the connector assembly 1 of this embodiment comprises an upper connector housing (hereinafter referred to as "upper housing") 3, having many juxtaposed male terminals 2, a lower connector housing (hereinafter referred to as "lower housing") 5, having many juxtaposed male terminals 4, and a cover 6.

Convex portions 8 are formed on and project downwardly respectively from opposite side portions of a lower surface 7 of the upper housing 3 at a front end thereof. Projections 10 are formed respectively on outer surfaces of opposite side walls 9 of the upper housing 3 at a rear end portion thereof, and rear surfaces (right-hand surface in FIG. 1) 10*a* of the projections 10 are tapering. Three elongate projections (convex portions) 11 are formed on the lower surface 7 of the upper housing 3 at the front end thereof, and are spaced from one another in a direction of the width of the upper housing 3, and extend in a forward-rearward direction (that is, in a direction of extending of the male terminals 2). As shown in FIG. 2, the elongate projections 11 conform in shape to dovetail grooves 17 formed in the lower housing 5 (described later).

Upwardly-extending tongue portions 12 are formed respectively on opposite sides of a rear end portion of the lower housing 5. Holes 13, in which the projections 10 on the upper housing 3 can be engaged, respectively, are formed in the tongue portions 12, respectively. A hole 14, used for attaching the cover 6, is formed in each of the tongue portions 12, and is disposed below the hole 13. The dovetail grooves 17 are formed respectively in those portions of an upper surface 15 of the lower housing 5, corresponding respectively to the elongate projections 11 on the upper housing 3, the dovetail grooves 17 being open to a front end surface 16 of the lower housing 5. Notches 18, corresponding respectively to the convex portions 8 on the upper housing 3, are formed respectively in opposite side portions of the upper surface 15 of the lower housing 5.

Projections 19 for engagement respectively in the holes 14 in the lower housing 5 are formed respectively on outer surfaces of opposite side walls of the cover 6 at a rear end portion thereof, and lower surfaces 19*a* of the projections 19 are tapering.

The other portions of the connector assembly of this embodiment are similar to those of the above-mentioned, related connector assembly 20, and therefore explanation thereof will be omitted here.

In this connector assembly 1, the cover 6 is placed on the lower housing 5, and the projections 19 on the cover 6 are fitted respectively into the holes 14 in the lower housing 5 from the upper side, thereby connecting the cover 6 to the lower housing 5.

Figure 3A:
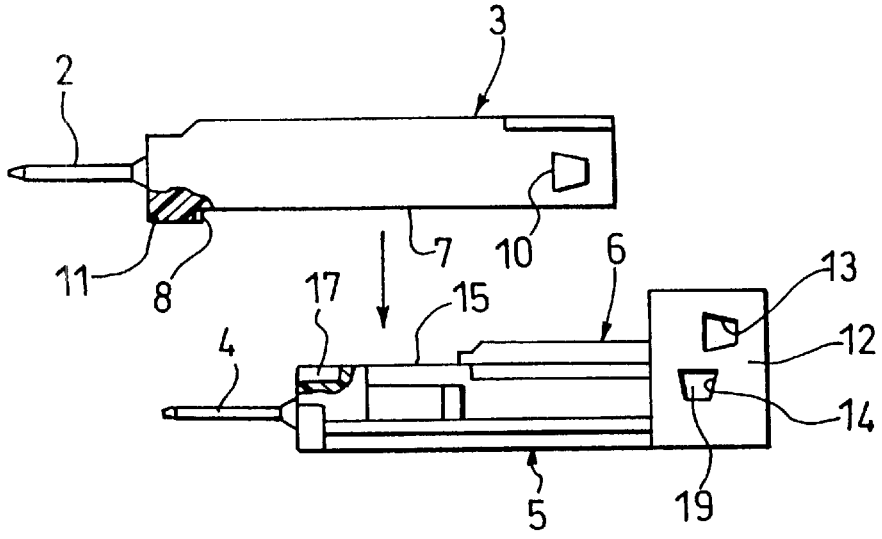
FIGS. 3A to 3C are schematic views showing the procedure of a combining operation of the connector assembly of FIG. 1.

Then, the upper housing 3 is located above the lower housing 5 as shown in FIG. 3A, and then is moved downward, as indicated by an arrow, to be superposed on the lower housing 5.

Figure 3B:
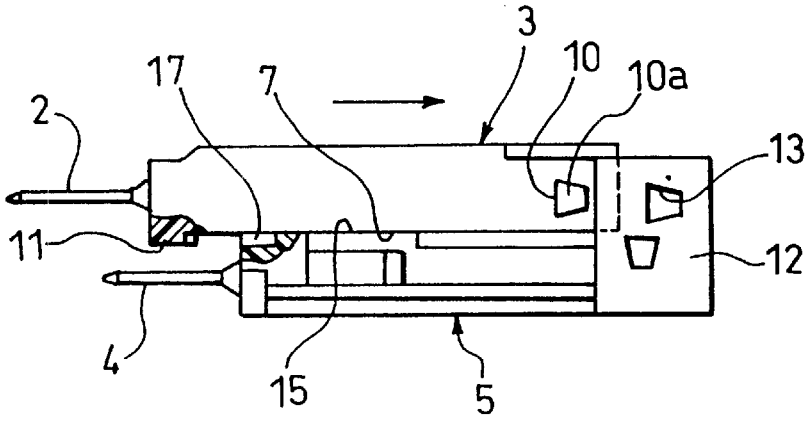

Then, the upper housing 3 is moved as indicated by an arrow in FIG. 3B while the lower surface 7 of the upper housing 3 is held against the upper surface 15 of the lower housing 5.

Figure 3C:
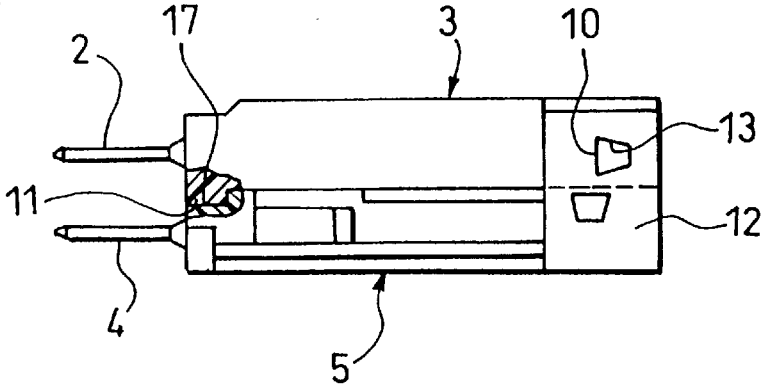
Figure 4:
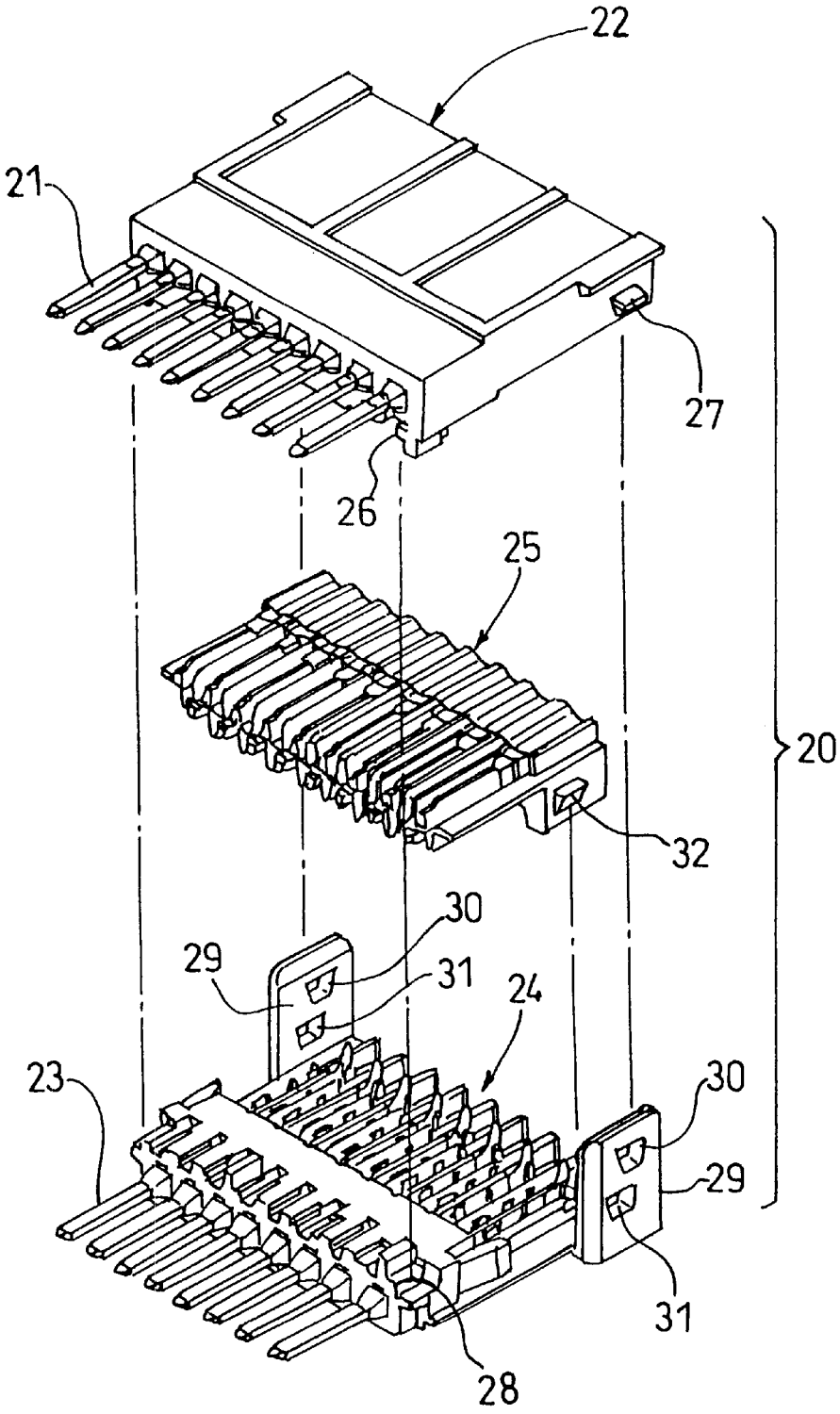
FIG. 4 RELATED ART
FIG. 4 is an exploded, perspective view of a related connector assembly.
Figure 5:
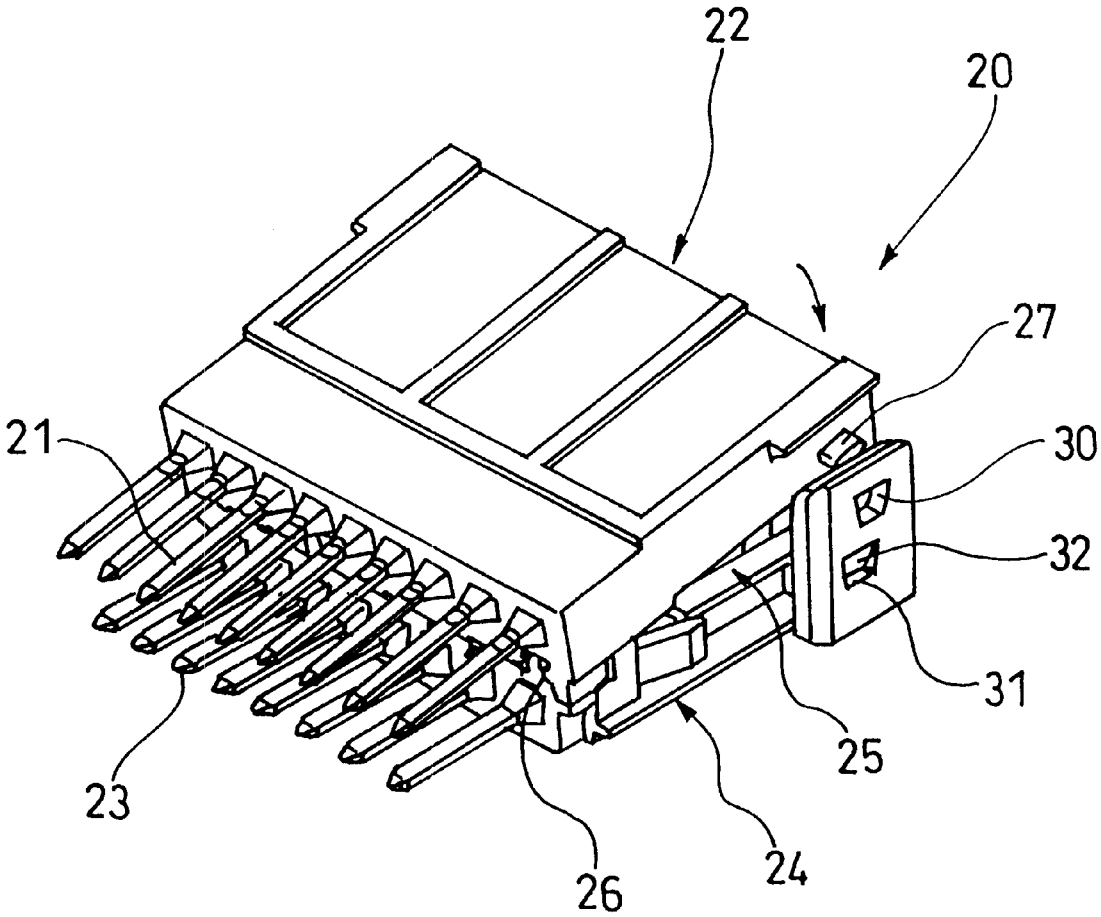
FIG. 5 RELATED ART
FIG. 5 is a perspective view showing the manner of combining an upper connector housing of the connector assembly of FIG. 4 with a lower connector housing thereof.

As a result, the two projections 10 on the upper housing 3 force the two tongue portions 12 and 12 away from each other by their respective tapering surfaces 10*a*, and intrude between the tongue portions 12 and 12, and then these projections 10 are engaged respectively in the holes 13, thereby combining the upper housing 3 with the lower housing 5, as shown in FIG. 3C.

At this time, the convex portions 8 on the upper housing 3 intrude respectively into the notches 18 in the lower housing 5, thereby positioning the front end portion of the upper housing 3 relative to the lower housing 3 in the direction of the width thereof. Therefore, the elongate projections 11 on the upper housing 3 are aligned with the dovetail grooves 17 in the lower housing 5, respectively.

Then, when the upper housing 3 is pushed in such a direction as to be combined with the lower housing 5, the elongate projections 11 on the upper housing 3 are fitted respectively into the dovetail grooves 17 in the lower housing 5. Then, when the upper housing 3 is further pushed in this condition, the upper housing 3 is guided by the dovetail grooves 17, and the projections 10 are fitted respectively into the holes 13 in the lower housing 5.

In the above embodiment, although the elongate projections 11 and the dovetail grooves 17 are provided at the front end portions of the two connector housings 3 and 5, this is not of absolute necessity, but the elongate projections 11 and the dovetail grooves 17 can be provided at the intermediate portions of the two housings 3 and 5.

In the above embodiment, although the three dovetail grooves 17 and the three elongate projections 11 are provided, the number of these can be suitably determined. When the number of the elongate projections 11, as well as the number of the dovetail grooves 17, is three, these are arranged or distributed over the entire width of the two housings 3 and 5, and therefore the separation of the two housings 3 and 5 from each other can be sufficiently prevented over the entire width thereof. However, this number may be more than three or less than three if necessary.

The dovetail grooves 17 and the elongate projections 11 do not always need to have a dovetail shape, but they may have any other suitable shape in so far as the projection 11 will not be disengaged from the groove 17 in a direction perpendicular to the surfaces of the two housings 3 and 5 engaged with each other. In the present invention, the terms "dovetail groove 17" and "elongate projection 11" should be construed to also mean those groove and projection of such shapes.

In the above illustrated embodiment, although the two housings, that is, the upper housing 3 and the lower housing 5, are combined together in a stacked manner, the present invention can be applied to a connector assembly in which three or more housings are combined together.

In the connector assembly of the present invention, the dovetail grooves and the elongate projections for fitting respectively in the dovetail grooves are provided at the engagement portions of the two connector housings to be engaged with each other, and the upper connector housing is slid relative to the lower connector housing in the direction of extending of the male terminals through the dovetail grooves and the elongate projections so as to fittingly connect the upper connector housing to the lower connector housing.

Therefore, in the connector assembly of the present invention, the elongate projections, formed on one of the upper and lower connector housings, are fitted respectively in the dovetail grooves formed in the other connector housing, so that the two connector housings can be positively combined together without being separated from each other.

In the connector assembly of the present invention, in addition to the above construction, the projections are formed on one of the two connector housings while the holes are formed in the other connector housing, and the upper connector housing is slid relative to the lower connector housing in the direction of extending of the male terminals through the projections and the holes so as to engage the upper connector housing with the lower connector housing, and the dovetail grooves and the elongate projections are provided at the front end portions of the two connector housings.

Therefore, in this connector assembly, the upper connector housing can be engaged with the lower connector housing merely by sliding the former relative to the latter. Therefore, the combining operation is easy, and besides the elongate projections, formed on one of the upper and lower connector housings, are fitted respectively in the dovetail grooves formed in the other connector housing, so that the two connector housings are combined together, and therefore the two connector housings can be combined together without being displaced relative to each other in the direction of the width and also without being separated from each other.

What is claimed is:

1. A connector, comprising:

a lower connector housing having a first engagement portion;

an upper connector housing stackable on and combinable with the lower connector housing, the upper connector housing having a second engagement portion;

a plurality of terminals insertable into the upper and lower connector housings, the terminals extending in a common direction when the upper and lower connector housings are completely combined together;

at least one dovetail groove formed in one of the first and second engagement portions;

at least one elongate projection formed on the other one of the first and second engagement portions, the at least one elongate projection being fitted in the at least one dovetail groove while the upper connector housing is slid relative to the lower connector housing in an extending direction of the terminals, wherein the upper connector housing has one of a projection and a hole at a rear end portion thereof, the lower connector housing has the other one of the projection and the hole at a rear end portion thereof, the upper connector housing has the second engagement portion at a front end portion thereof, and the lower connector housing has the first engagement portion at a front end portion thereof, and wherein the upper connector housing is slid relative to the lower connector housing in the extending direction of the terminals, and is completely combined with the lower connector housing, so that the at least one elongate projection is fitted in the at least one dovetail groove, and the projection and the hole are engaged with each other; and a cover attachable between the upper and lower connector housings so as to partially cover the terminals respectively arranged in the upper and lower connector housings.

2. A connector, comprising:

a lower connector housing having a first engagement portion;

an upper connector housing stackable on and combinable with the lower connector housing, the upper connector housing having a second engagement portion;

a plurality of terminals insertable into the upper and lower connector housings, the terminals extending in a common direction when the upper and lower connector housings are completely combined together;

at least one dovetail groove formed in one of the first and second engagement portions;

at least one elongate projection formed on the other one of the first and second engagement portions, the at least one elongate projection being fitted in the at least one dovetail groove while the upper connector housing is slid relative to the lower connector housing in an extending direction of the terminals, and a cover attachable between the upper and lower connector housings so as to partially cover the terminals respectively arranged in the upper and lower connector housings.

3. The connector of claim 2, wherein the terminals are exposed after the connector housing have been combined but prior to attachment of the cover.

* * * * *